US007438393B2

(12) United States Patent
Park

(10) Patent No.: US 7,438,393 B2
(45) Date of Patent: Oct. 21, 2008

(54) INK-JET PRINT HEAD

(75) Inventor: Ju-Hyun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 313 days.

(21) Appl. No.: 10/943,958

(22) Filed: Sep. 20, 2004

(65) Prior Publication Data

US 2005/0157092 A1 Jul. 21, 2005

(30) Foreign Application Priority Data

Jan. 20, 2004 (KR) ..... 10-2004-0004377

(51) Int. Cl.
*B41J 2/045* (2006.01)

(52) U.S. Cl. ..... 347/68; 347/70

(58) Field of Classification Search ..... 347/68, 347/70–71

See application file for complete search history.

(56) References Cited

U.S. PATENT DOCUMENTS 5,510,819 A * 4/1996 Fujimoto et al. ..... 347/70
5,767,612 A * 6/1998 Takeuchi et al. ..... 347/70
5,831,651 A * 11/1998 Usui et al. ..... 347/70
6,378,995 B1 * 4/2002 Yun et al. ..... 347/70
7,213,912 B2 * 5/2007 Ito et al. ..... 347/72

FOREIGN PATENT DOCUMENTS

| | | | |
|---|---|---|---|
| JP | 03-216343 | | 9/1991 |
| JP | 03-216344 | | 9/1991 |
| JP | 05305710 | A * | 11/1993 |
| JP | 11-300971 | | 11/1999 |
| JP | 11-314366 | | 11/1999 |
| KR | 10-2001-0012051 | A | 2/2001 |

* cited by examiner

*Primary Examiner*—Matthew Luu
*Assistant Examiner*—Lisa M Solomon
(74) *Attorney, Agent, or Firm*—Roylance, Abrams, Berdo & Goodman, LLP

(57) ABSTRACT

An ink-jet print head including a nozzle plate which is provided with a nozzle through which ink is ejected, a chamber plate which is provided with a pressure chamber communicating with the nozzle through an ink outlet and which is disposed over the nozzle plate, and a vibrating plate forming one surface of the pressure chamber and which is disposed on the chamber plate to be opposite to the nozzle plate. An actuator is disposed on the vibrating plate substantially above the pressure chamber, and overlapping at least a part of a side wall defining a width of the pressure chamber and a part of the pressure chamber.

7 Claims, 5 Drawing Sheets

INK-JET PRINT HEAD

CROSS-REFERENCE TO RELATED APPLICATION

This application claims the benefit under 35 U.S.C. §119 (a) of Korean Patent Application No. 2004-04377 entitled "Ink-Jet Print Head", filed in the Korean Intellectual Property Office on Jan. 20, 2004, the entire contents of which are incorporated herein by reference.

BACKGROUND OF THE INVENTION

1. Field of the Invention

The present invention relates to a print head. More particularly, the present invention relates to a piezoelectric ink-jet print head having selectively positioned actuators for precise operation.

2. Description of the Related Art

An ink-jet print head is a device which prints a picture with a predetermined color by ejecting a minute ink droplet onto a desired position of a printing medium. Such ink-jet print heads are divided according to the incorporated ink droplet ejection method into an electric-thermal transfer method, in which bubbles generated by heat cause the ink droplet to be ejected, and an electric-mechanical transfer method, in which a volume change due to deformation of piezoelectric elements is used to eject the ink droplet.

FIG. 1 is a partial cross-sectional view showing a general piezoelectric inkjet print head.

Referring to FIG. 1, the ink-jet print head includes a structure generally comprising a nozzle plate 300 provided with a nozzle 302, a reservoir plate 304 provided with a reservoir 306, a channel plate 308 provided with an ink inlet 310, a restrictor plate 312 provided with a restrictor 314, a chamber plate 316 provided with a pressure chamber 317, a vibrating plate 318, and an actuator 320, which are stacked as shown.

The actuator 320 includes a lower electrode 320*a*, a piezoelectric film 320*b*, and an upper electrode 320*c*, which are sequentially stacked. The pressure chamber 317 communicates with the nozzle 302 through an ink outlet 313 which passes through the restrictor plate 312, the channel plate 308, and the reservoir plate 304.

The ink supplied from an ink reservoir (not shown) is stored in the reservoir 306 and then flows into the pressure chamber 317 through the ink inlet 310. At this point, the restrictor 314, which is interposed between the ink inlet 310 and the pressure chamber 317, is employed to keep the inflow of the ink into the pressure chamber 317 at a constant speed.

When a voltage is applied between the upper electrode 320*c* and the lower electrode 320*a* of the actuator 320 disposed above the pressure chamber 317, the piezoelectric film 320*b* is energized and thus the vibrating plate 318 is deformed, thereby decreasing the volume of the pressure chamber 317. The pressure caused by such a decrease in the volume of the pressure chamber 317 results in the print head ejecting the ink from the pressure chamber 317 onto the printing medium through the ink outlet 313 and the nozzle 302.

FIG. 2 is a cross-sectional view showing a conventional piezoelectric ink-jet print head, taken along the line A-A of FIG. 1. Specifically, FIG. 2 shows a cross-section of a print head illustrating the width of pressure chamber 112. Hereinafter, the width direction of the pressure chamber 112 will be used as a short-axis direction thereof.

Referring to FIG. 2, the conventional ink-jet print head has a structure generally comprising a nozzle plate 100 provided with a nozzle 102, a reservoir plate 104, a channel plate 106, a restrictor plate 108, a chamber plate 110 provided with a pressure chamber 112, a vibrating plate 114, and an actuator 116, which are sequentially stacked. The actuator 116 includes a lower electrode 116*a*, a piezoelectric film 116*b*, and an upper electrode 116*c*, which are also sequentially stacked. The pressure chamber 112 communicates with the nozzle 102 through an ink outlet 109. As shown in FIG. 2, in the conventional ink-jet print head, the actuator 116 is disposed above the pressure chamber 112 and substantially covers the entire pressure chamber 112 in the width direction thereof. Therefore, any deformation of the actuator 116 is transferred entirely to the pressure chamber 112 via the vibrating plate 114. Therefore, too much pressure is often applied to the pressure chamber 112 when the actuator is energized, and thus, can limit the ability of the print head to decrease the size of the ink droplet, which is adjusted by the pressure.

Accordingly, a need exists for a print head in which an actuator and pressure chamber configuration is provided having greater control over a constant volume, such that the number of nozzles 102 per a unit area is not restricted.

SUMMARY OF THE INVENTION

It is, therefore, an object of the present invention to provide an ink-jet print head in which the size of an ink droplet can be controlled by adjusting the size of an overlapped area between a pressure chamber and an actuator, and thereby allowing the number of nozzles per a unit area to be increased.

To achieve the above and other purposes, one object of the present invention is to provide an ink-jet print head having selectively positioned actuators for precise operation. According to one embodiment of the present invention, the ink-jet print head comprises a nozzle plate, which is provided with a nozzle through which ink is ejected. A chamber plate, which is provided with a pressure chamber communicating with the nozzle through an ink outlet, is disposed over the nozzle plate. A vibrating plate, forming one surface of the pressure chamber, is disposed on the chamber plate to be opposite to the nozzle plate. An actuator is disposed on the vibrating plate above a pressure chamber and at least one pressure chamber wall in such a manner as to overlap at least a part of the side wall defining a width of the pressure chamber, and also overlap a part of one adjacent pressure chamber. In such a position, the actuator is spaced apart from the other side wall defining the width of the pressure chamber such that the entire width of the pressure chamber is not entirely overlapped by the actuator.

According to another embodiment of the present invention, the actuator overlaps one entire side wall defining the width of the pressure chamber and extends partially over both adjacent pressure chambers sharing the one side wall.

According to still another embodiment of the present invention, an ink-jet print head comprises a nozzle plate provided with a plurality of nozzles through which ink is ejected. A chamber plate, which is provided with a plurality of pressure chambers each communicating with the plurality of nozzles through an ink outlet, is disposed over the nozzle plate. A vibrating plate, forming one surface of the pressure chamber, is disposed on the chamber plate to be opposite to the nozzle plate. An actuator is disposed on the vibrating plate to overlap alternate side walls, wherein the side walls define the width of the pressure chambers, and to be partially extended over the pressure chambers sharing the overlapped side walls.

BRIEF DESCRIPTION OF THE DRAWINGS

The above and other features and advantages of the present invention will become more apparent from the following detailed description of the preferred embodiments with reference to the attached drawings in which.

DETAILED DESCRIPTION OF THE EXEMPLARY EMBODIMENTS

Figure 1:
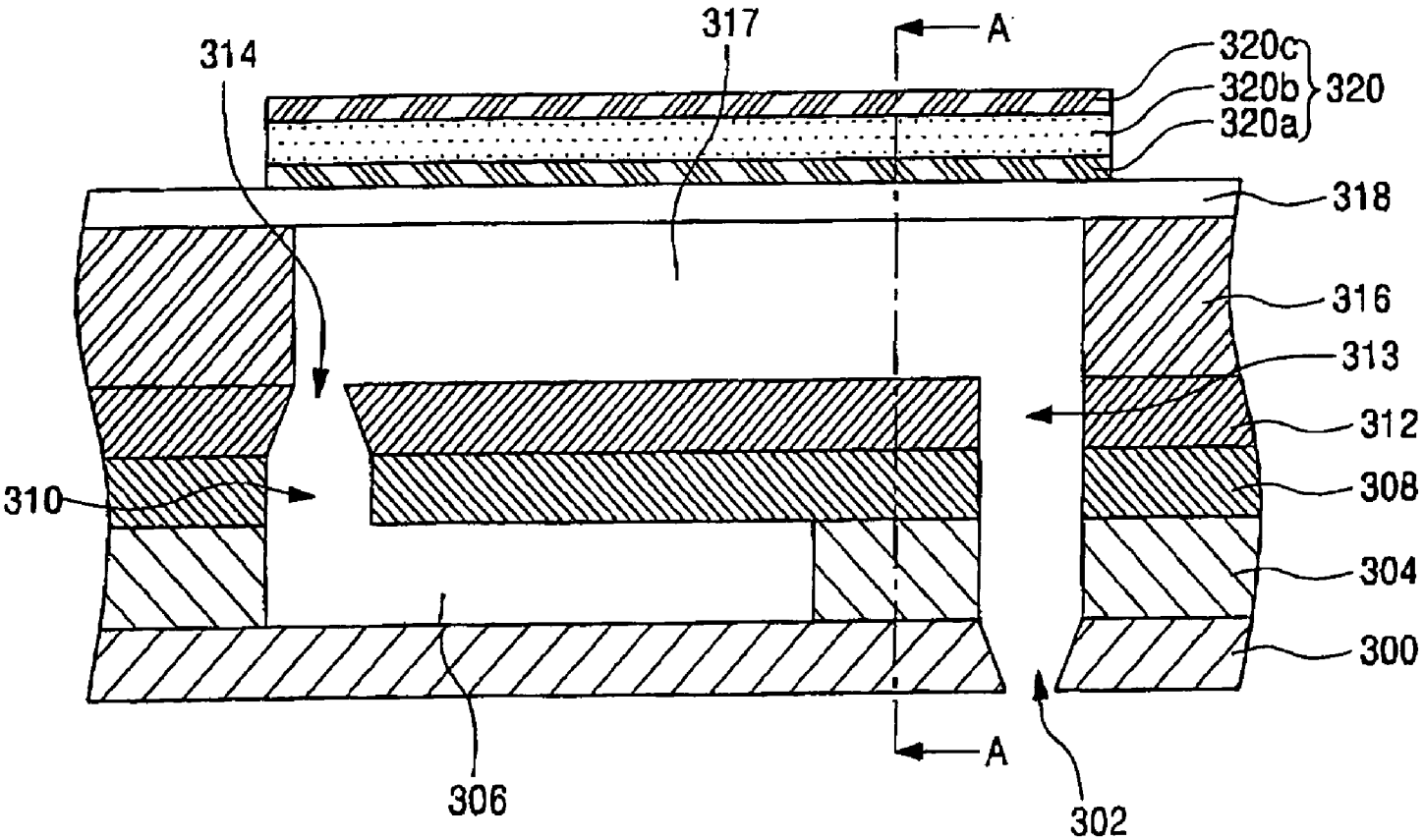
FIG. 1 (PRIOR ART)
FIG. 1 is a partial cross-sectional view showing a conventional piezoelectric ink-jet print head.
Figure 2:
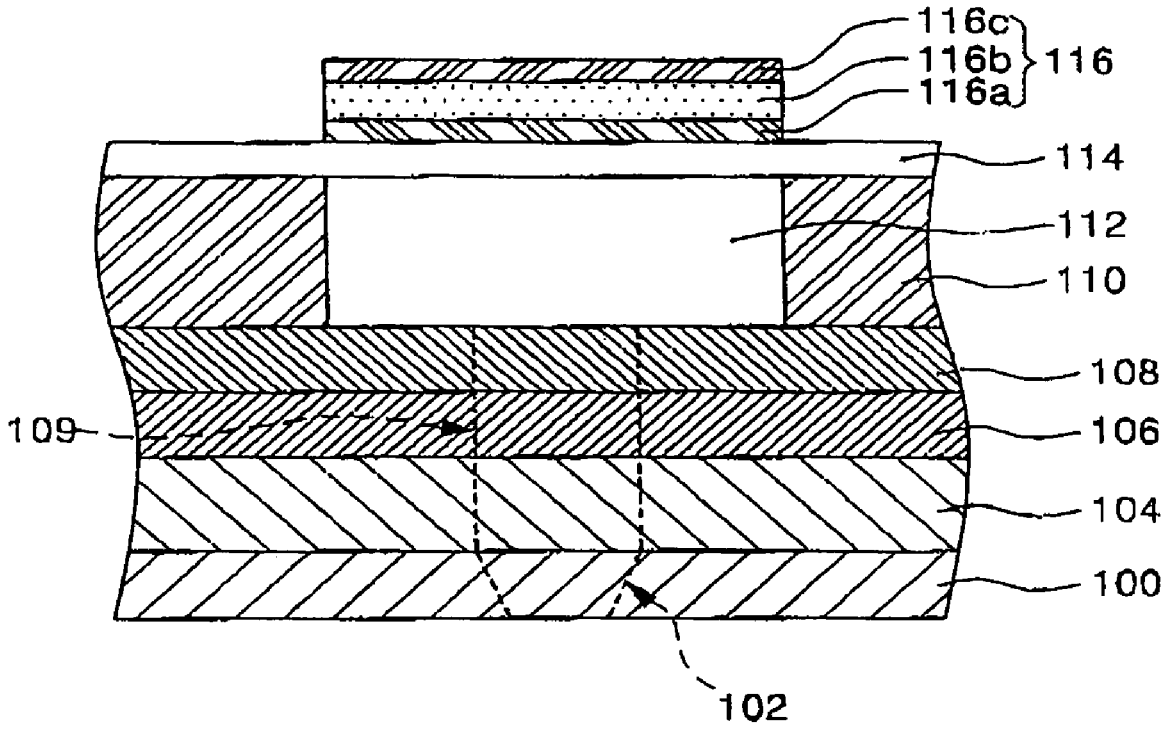
FIG. 2 (PRIOR ART)
FIG. 2 is a cross-sectional view showing a conventional piezoelectric ink-jet print head, taken along the line A-A of FIG. 1.

The present invention will now be described in greater detail with reference to the accompanying drawings, in which preferred embodiments of the invention are shown. The invention may, however, be embodied in different forms and should not be construed as limited to the embodiments set forth herein. Rather, these embodiments are provided such that this disclosure will be thorough and complete, and will fully convey the scope of the invention to those skilled in the art. In the drawings, the thickness of layers and regions are exaggerated for clarity. Like numbers refer to like elements throughout the specification.

Figure 3:
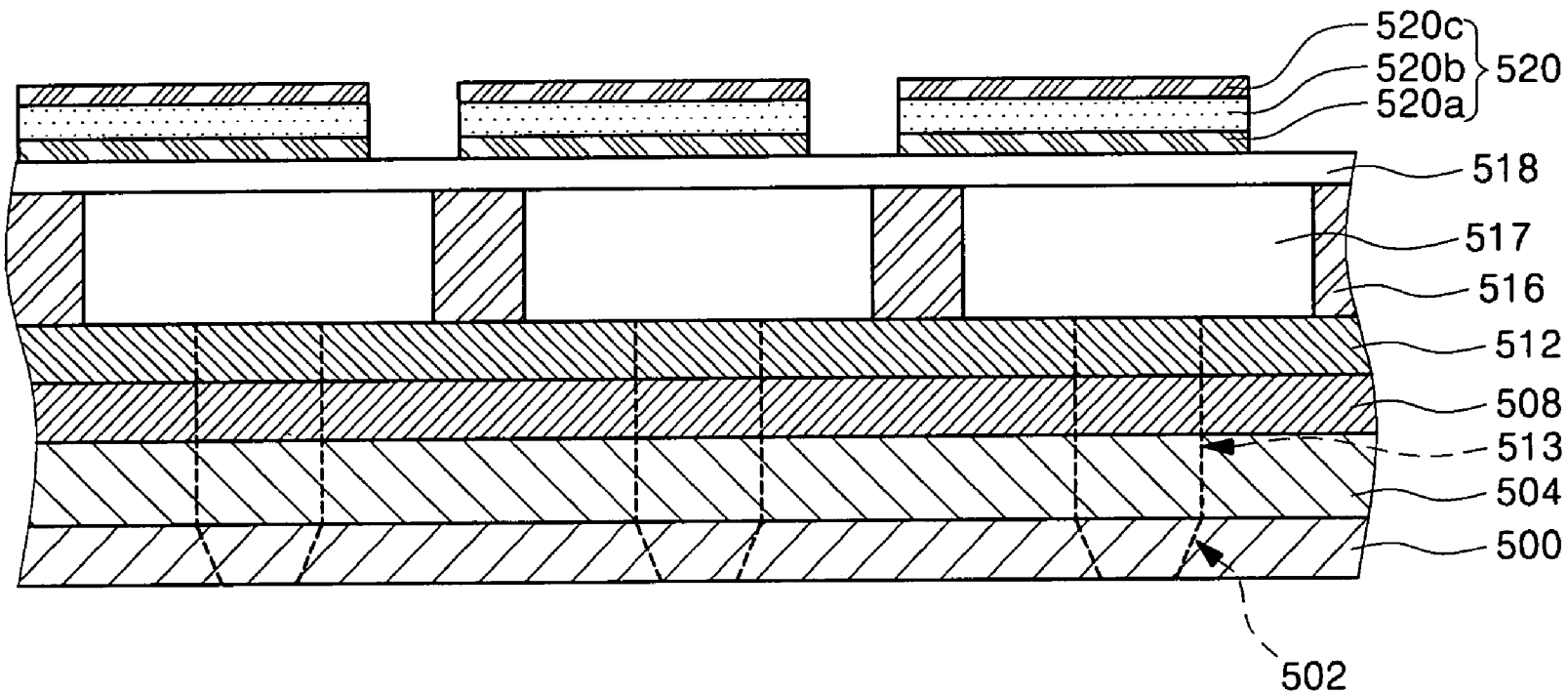
FIG. 3 is a cross-sectional view showing a piezoelectric ink-jet print head according to a first embodiment of the present invention, taken along the line A-A of FIG. 1.

FIG. 3 is a cross-sectional view showing a piezoelectric ink-jet print head according to a first embodiment of the present invention, taken along the line A-A of FIG. 1. That is, FIG. 3 is a partial cross-sectional view of a piezoelectric ink-jet print head according to a first embodiment of the present invention, taken along a width direction of a pressure chamber.

Referring to FIG. 3, a nozzle plate 500 is provided with nozzles 502 through which ink is ejected. The nozzle plate can be constructed of any suitable material, for example, the nozzle plate 500 can be a silicon substrate. On the nozzle plate 500, a reservoir plate 504, a channel plate 508, and a restrictor plate 512 are sequentially stacked. On the restrictor plate 512, a chamber plate 516 is stacked and is provided with pressure chambers 517. The pressure chambers 517 communicate with the nozzles 502 through ink outlets 513. The chamber plate 516 can be constructed of any suitable material, for example, the chamber plate 516 can be made of a photosensitive high-molecular compound or metal. The materials and methods to form the nozzle plate 500, the reservoir plate 504, the channel plate 508, the restrictor plate 512 and the chamber plate 516 can vary using techniques well-known to those skilled in the art.

Returning to FIG. 3, the print head further includes a vibrating plate 518 forming one surface of the pressure chamber 517. The vibrating plate 518 is disposed on the chamber plate 516 to be opposite to the nozzle plate 500. In this embodiment, the vibrating plate 518 can be made of a metal such as nickel, a ceramic material such as silicon or silicon carbide, or a high-molecular compound.

Actuators 520 are disposed on the vibrating plate 518. Each of the actuators 520 includes a lower electrode 520*a*, a piezoelectric film 520*b*, and an upper electrode 520*c*, which are sequentially stacked. The lower and upper electrodes 520*a* and 520*c* can be formed by any suitable method, such as vapor deposition, sputtering or screen printing, and the like, with a metal such as gold (Au), silver (Ag), nickel (Ni), platinum (Pt), or similar metal, or an alloy such as nickel/chrome (Ni/Cr), or similar alloy. The piezoelectric film 520*b* can be made of a dielectric material having desired piezoelectric characteristics, for example, a PZT-based compound, and can be formed by screen printing methods.

According to a first embodiment of the present invention as shown in FIG. 3, the actuators 520 are disposed above the pressure chambers 517 such that each continuously overlaps a part of one side wall defining each pressure chamber 517 in a width direction and further overlaps a part of the adjacent pressure chamber 517. In such a position, the actuator 520 is spaced from the other side wall defining the pressure chamber 517 in the width direction. That is, the actuators 520 are disposed above the pressure chambers 517 such that each does not overlap the entire area of the pressure chamber 517 in the width direction. Therefore, a part of each actuator 520 is no longer able to affect a decrease in the volume of the pressure chambers 517, thereby decreasing a pressure to be applied to the pressure chambers 517. Thus, according to the first embodiment of the present invention, the actuators 520 partially overlap the pressure chambers 517 in the width direction, such that the pressure to be applied to the pressure chambers 517 can be adjusted, and thereby adjusting the size of the ink droplet to be ejected through the nozzles 502.

Figure 4:
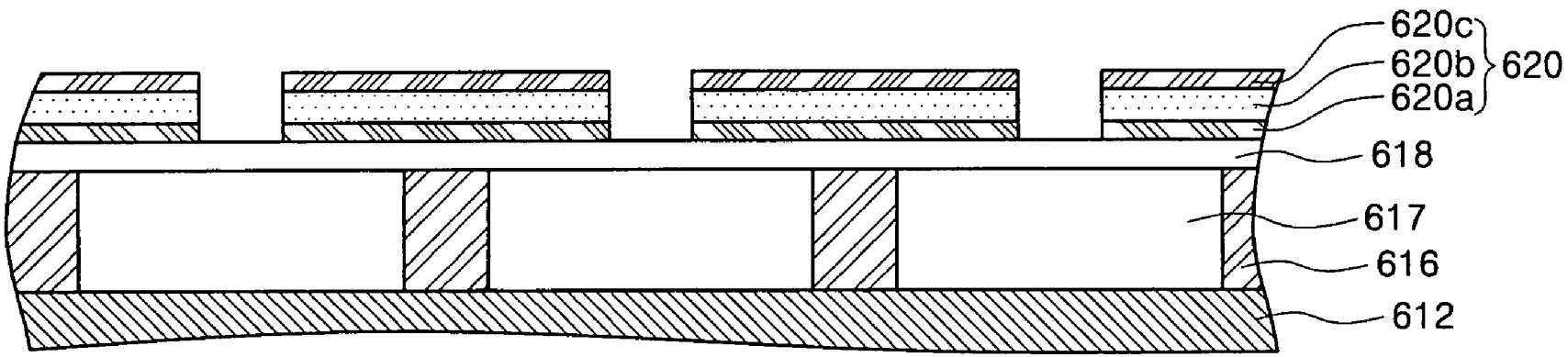
FIG. 4 is a cross-sectional view showing a piezoelectric ink-jet print head according to a second embodiment of the present invention, taken along the line A-A of FIG. 1.

FIG. 4 is a cross-sectional view showing a piezoelectric ink-jet print head according to a second embodiment of the present invention, taken along the line A-A of FIG. 1. That is, FIG. 4 is a partial cross-sectional view of a piezoelectric inkjet print head according to a second embodiment of the present invention, taken along a width direction of a pressure chamber.

Referring to FIG. 4, according to the second embodiment of the present invention, a number of plates are sequentially stacked on the restrictor plate 612, including a chamber plate 616, which is provided with pressure chambers 617, and a vibrating plate 618, similar to the plate arrangement of the first embodiment described above. Also, a structure below the restrictor plate 612 (not shown) is similar to the arrangement of the first embodiment.

On the vibrating plate 618 of FIG. 4, actuators 620 are disposed, wherein each of the actuators 620 include a lower electrode 620*a*, a piezoelectric film 620*b* and an upper electrode 620*c*, which are sequentially stacked. According to the second embodiment of the present invention as shown in FIG. 4, the actuators 620 are disposed above the pressure chambers 617 such that each entirely overlap one side wall defining the width of the pressure chamber 617 and partially extend over the adjacent pressure chambers 617 sharing the one side wall. That is, the actuators 620 cover the entire width of the side walls of the pressure chambers 617 and extend to partially cover the pressure chambers 617 sharing the side walls. In this case, as in the first embodiment, the pressure to be applied to the pressure chambers 617 can be controlled, thereby adjusting the size of the ink droplet to be ejected through the nozzles.

Figure 5:
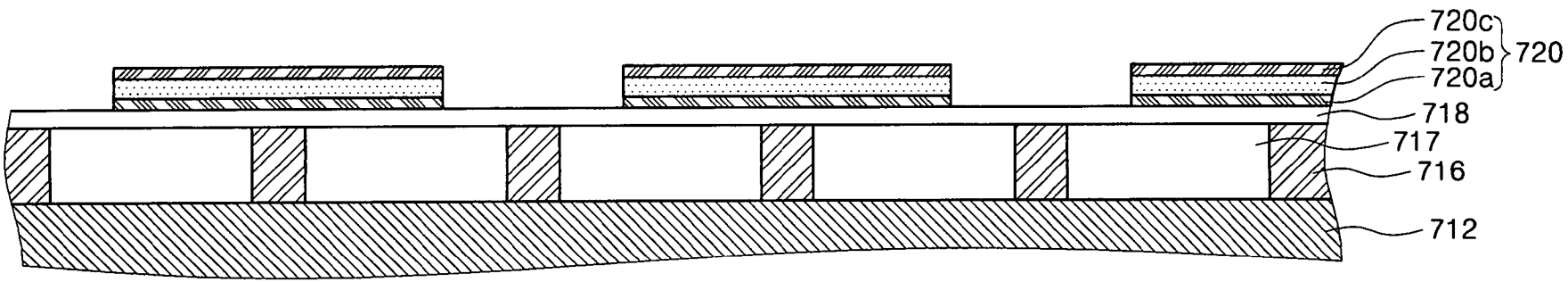
FIG. 5 is a cross-sectional view showing a piezoelectric ink-jet print head according to a third embodiment of the present invention, taken along the line A-A of FIG. 1.

FIG. 5 is a cross-sectional view showing a piezoelectric ink-jet print head according to a third embodiment of the present invention, taken along the line A-A of FIG. 1. That is, FIG. 5 is a partial cross-sectional view of a piezoelectric ink-jet print head according to a third embodiment of the present invention, taken along a width direction of a pressure chamber.

Referring to FIG. 5, according to the third embodiment of the present invention, a number of plates are sequentially stacked on the restrictor plate 712, including a chamber plate 716, which is provided with pressure chambers 717, and a vibrating plate 718, similar to the plate arrangement of the first embodiment described above. Also, a structure below the restrictor plate 712 (not shown) is similar to the arrangement of the first embodiment.

On the vibrating plate 718 of FIG. 5, actuators 720 are disposed, wherein each of the actuators 720 includes a lower electrode 720*a*, a piezoelectric film 720*b* and an upper electrode 720*c*, which are sequentially stacked. According to the third embodiment of the present invention, the actuators 720 are disposed on the vibrating plate 718 above the pressure chambers 717 such that each overlaps every other side wall defining the width of the pressure chambers 717, and partially extends over the adjacent pressure chambers 717 sharing the overlapped side wall. In contrast to the second embodiment described above, in the ink-jet print head according to the third embodiment of the present invention, the actuators 720 are not arranged to overlap every side wall of the pressure chambers 717, but rather one of every two side walls (i.e., every other side wall), wherein the side walls define the width of the pressure chambers 717. In this case, the parts of the actuators 720 extended over the pressure chambers 717 each preferably has substantially the same width.

As illustrated above, according to the third embodiment of the present invention, the actuators 720 overlap with the one side wall forming the pressure chambers 717 and extend over the pressure chambers 717 sharing the overlapped side wall. Hence, the size of the ink droplet can be decreased, and the volume of the pressure chambers 717 can be decreased. Thus, the number of the pressure chambers 717 which can be disposed per a unit area can be increased, and nozzle density can be increased.

As described above, according to the embodiments of present invention, the area in which the pressure chamber and the actuator overlap in the piezoelectric ink-jet print head can be configured to allow greater control for adjusting the size of the ink droplet, and to allow an increased number of nozzles to be arranged per a unit area.

While the present invention has been described with reference to a number of particular embodiments, it is understood that the disclosure has been made for purpose of illustrating the invention by way of examples and is not intended to limit the scope of the invention, which is defined in the following claims and their equivalents.

What is claimed is:

1. An ink-jet print head, comprising:

a nozzle plate provided with a nozzle;

a chamber plate provided with a pressure chamber communicating with the nozzle through an ink outlet;

a vibrating plate being disposed opposite to the nozzle plate and forming one surface of the pressure chamber; and an actuator being disposed on the vibrating plate to continuously overlap one side wall defining the width of the pressure chamber, and to partially extend over the pressure chambers sharing the one side wall.

2. The ink-jet print head as claimed in claim 1, wherein the actuator includes a lower electrode, a piezoelectric film, and an upper electrode, which are sequentially stacked.

3. The ink-jet print head as claimed in claim 1, further comprising:

a channel plate interposed between the nozzle plate and the chamber plate;

a reservoir plate interposed between the nozzle plate and the channel plate; and a restrictor plate interposed between the channel plate and the chamber plate.

4. An ink-jet print head, comprising:

a nozzle plate provided with a plurality of nozzles;

a chamber plate provided with a plurality of pressure chambers each communicating with the plurality of nozzles through an ink outlet;

a vibrating plate being disposed opposite to the nozzle plate and forming one surface of the plurality of pressure chambers; and a plurality of actuators being disposed on the vibrating plate to overlap every other side wall defining a width of each pressure chamber and to partially extend over the pressure chambers sharing the overlapped side walls, wherein each actuator continuously overlaps the side wall and partially extends over the pressure chambers sharing the overlapped side wall.

5. The ink-jet print head as claimed in claim 4, wherein the actuator includes a lower electrode, a piezoelectric film, and an upper electrode, which are sequentially stacked.

6. The ink-jet print head as claimed in claim 4, wherein each actuator extends over each pressure chamber a substantially equal distance, respectively.

7. The ink-jet print head as claimed in claim 4, further comprising:

a channel plate interposed between the nozzle plate and the chamber plate;

a reservoir plate interposed between the nozzle plate and the channel plate; and a restrictor plate interposed between the channel plate and the chamber plate.

* * * * *